US006550465B2

(12) United States Patent
Ueno et al.

(10) Patent No.: US 6,550,465 B2
(45) Date of Patent: Apr. 22, 2003

(54) CYLINDER AIR/FUEL RATIO ESTIMATION SYSTEM OF INTERNAL COMBUSTION ENGINE

(75) Inventors: Masaki Ueno, Wako (JP); Yasunori Ehara, Wako (JP); Masahiro Sato, Wako (JP); Ken Ogawa, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 10 days.

(21) Appl. No.: 09/904,476

(22) Filed: Jul. 16, 2001

(65) Prior Publication Data

US 2002/0026930 A1 Mar. 7, 2002

(30) Foreign Application Priority Data

Jul. 17, 2000 (JP) ..... 2000-216013

(51) Int. Cl.[7] ..... F02D 41/00
(52) U.S. Cl. ..... 123/679; 701/109
(58) Field of Search ..... 123/295, 305, 123/679, 681, 687; 701/109

(56) References Cited

U.S. PATENT DOCUMENTS 5,524,598 A 6/1996 Hasegawa et al.
5,548,514 A 8/1996 Hasegawa et al.
5,600,056 A 2/1997 Hasegawa et al.
6,349,698 B2 * 2/2002 Park ..... 123/295
6,352,490 B1 * 3/2002 Makki et al. ..... 123/295

FOREIGN PATENT DOCUMENTS

JP 4-37264 6/1992

* cited by examiner

*Primary Examiner*—John Kwon
(74) *Attorney, Agent, or Firm*—Arent Fox Kintner Plotkin & Kahn, PLLC

(57) ABSTRACT

In a direct injection spark ignition engine which is operable in three operation modes including a stoichiometric air/fuel ratio operation mode, a pre-mixture combustion mode and a stratified combustion operation mode which are different in the desired air/fuel ratio and a single air/fuel ratio sensor installed downstream of the exhaust manifold, the sensor output is successively sampled and one from among the sampled data is selected based on the engine speed and engine load and selected one of the operation modes such that the air/fuel ratio at each cylinder can be accurately estimated for the selected operation mode under the engine operating conditions.

28 Claims, 9 Drawing Sheets

FIG. 5

| NE \ PBA | PBCSEL1 | . . . | PBCSEL10 |
|---|---|---|---|
| NECSEL1 | CSEL 1, 1 | . . . | CSEL 1, 10 |
| ⋮ | ⋮ | | ⋮ |
| NECSEL10 | CSEL 10, 1 | . . . | CSEL 10, 10 |

CYLINDER AIR/FUEL RATIO ESTIMATION SYSTEM OF INTERNAL COMBUSTION ENGINE

BACKGROUND OF THE INVENTION

1. Field of the Invention

This invention relates to a cylinder air/fuel ratio estimation system of an internal combustion engine, more particularly to a system for estimating air/fuel ratios of each cylinder of a direct injection spark ignition multi-cylinder engine, in which gasoline fuel is directly injected into the combustion chamber of the engine.

2. Description of the Related Art

In an internal combustion engine having a plurality of cylinders, when only a single air/fuel ratio sensor is installed at or downstream of the confluence point of an exhaust manifold, since the sensor output merely indicates a mixed value of the air/fuel ratios exhausted by the whole cylinders, it becomes impossible to detect the air/fuel ratio in each cylinder accurately. In view of the above, the assignee proposes, in U.S. Pat. No. 5,524,598, estimating the air/fuel ratio in each cylinder based on a single air/fuel ratio sensor installed at or downstream of the confluence point of an exhaust manifold, based on a model established on the assumption that the sensor output indicates a weight-average value obtained by multiplying the past firing histories of the respective cylinders by a weight coefficient and an observer established to observe the internal state of the exhaust manifold expressed by the model.

Further, the time (or crank angles) at which the generated exhaust gas reaches or arrives the air/fuel ratio sensor varies with the engine operating conditions and some similar factors. Accordingly, the assignee proposes, in U.S. Pat. No. 5,600,056, sampling the sensor output successively and selecting one from among the sampled data by retrieving mapped data by engine operation parameters.

Furthermore, since the weight coefficient of the above-mentioned model varies with the engine operating conditions, the assignee proposes in U.S. Pat. No. 5,548,514, selecting and using one from among a plurality of observer gain matrices by similar engine operation parameters.

Aside from the above, a direct injection spark ignition engine has recently been proposed, as is disclosed in, for example, Japanese Patent Publication No. Hei 4 (1992)-37264. In the direct injection spark ignition engine, the engine operation is selected from one from three modes including a stoichiometric air/fuel ratio operation mode in which the desired air/fuel ratio is set to be the stoichiometric air/fuel ratio, a pre-mixture combustion operation mode (lean-burn operation mode) in which the desired air/fuel ratio is set to be an air/fuel ratio is leaner than the stoichiometric air/fuel ratio, and a stratified combustion operation mode (lean burn combustion operation mode) in which the desired air/fuel ratio is set to be a more leaner air/fuel ratio than that in the pre-mixture combustion operation mode, in response to the engine load.

In this kind of engine, even when the engine load remains unchanged, the aforesaid time (or crank angles) at which the exhaust gas reaches the air/fuel ratio sensor may vary with the respective operation modes, since the exhaust gas flow rate (or volume) varies with the operation modes. Further, the behavior of the air/fuel ratio sensor caused by the exhaust gas may be different for different operation modes.

SUMMARY OF THE INVENTION

An object of the present invention is therefore to provide a cylinder air/fuel estimation system of an internal combustion engine operable in a selected one of operation modes, which can select one from among sampled air/fuel ratio data correctly such that the air/fuel ratio at each cylinder can be accurately estimated for the selected operation mode.

This invention achieves this object by providing a system for estimating an air/fuel ratio of each cylinder of an internal combustion engine having a plurality of cylinders which are connected to an exhaust system having an exhaust manifold, including: an air/fuel ratio sensor installed at or downstream of a confluence point of the exhaust manifold and generating an output indicative of an air/fuel ratio exhausted from the cylinders; air/fuel ratio sensor output sampling module which A/D converts the output of the air/fuel ratio sensor and stores successively as sampled data; engine operating condition detecting module which detects operating conditions of the engine including at least an engine speed and an engine load; sampled data selecting module which selects one from among the sampled data based on at least the engine speed and the engine load in the detected operating conditions of the engine, and estimates the air/fuel ratio of each cylinder from the selected sampled data based on a model describing a behavior of the exhaust manifold and designed based on assumption that the output of the air/fuel ratio sensor comprises a weight-average obtained by multiplying past firing histories of the cylinders by a weight coefficient and an observer for observing an internal state of the model. The characteristic features of the system are that the system includes: operation mode selecting module which selects an operation mode of the engine from at least a first operation mode in which a desired air/fuel ratio is set to be a stoichiometric air/fuel ratio, a second operation mode in which the desired air/fuel ratio is set to be an air/fuel ratio leaner than the stoichiometric air/fuel ratio and a third operation mode in which the desired air/fuel ratio is set to be an air/fuel ratio leaner than that of the second operation mode; and the sampled data selecting module selects the one from among the sampled data based on at least the engine speed, the engine load and the selected operation mode, and estimates the air/fuel ratio of each cylinder from the selected sample, based on the model and the observer, for the selected operation mode of the engine.

BRIEF EXPLANATION OF THE DRAWINGS

This and other objects and advantages of the invention will be more apparent from the following description and drawings, in which:

FIG. 5 is an explanatory view showing the configuration of a CSEL.ST map referred to in the flow chart of FIG. 3;

DETAILED DESCRIPTION OF THE PREFERRED EMBODIMENTS

Embodiments of the present invention will now be explained with reference to the drawings.

Figure 1:
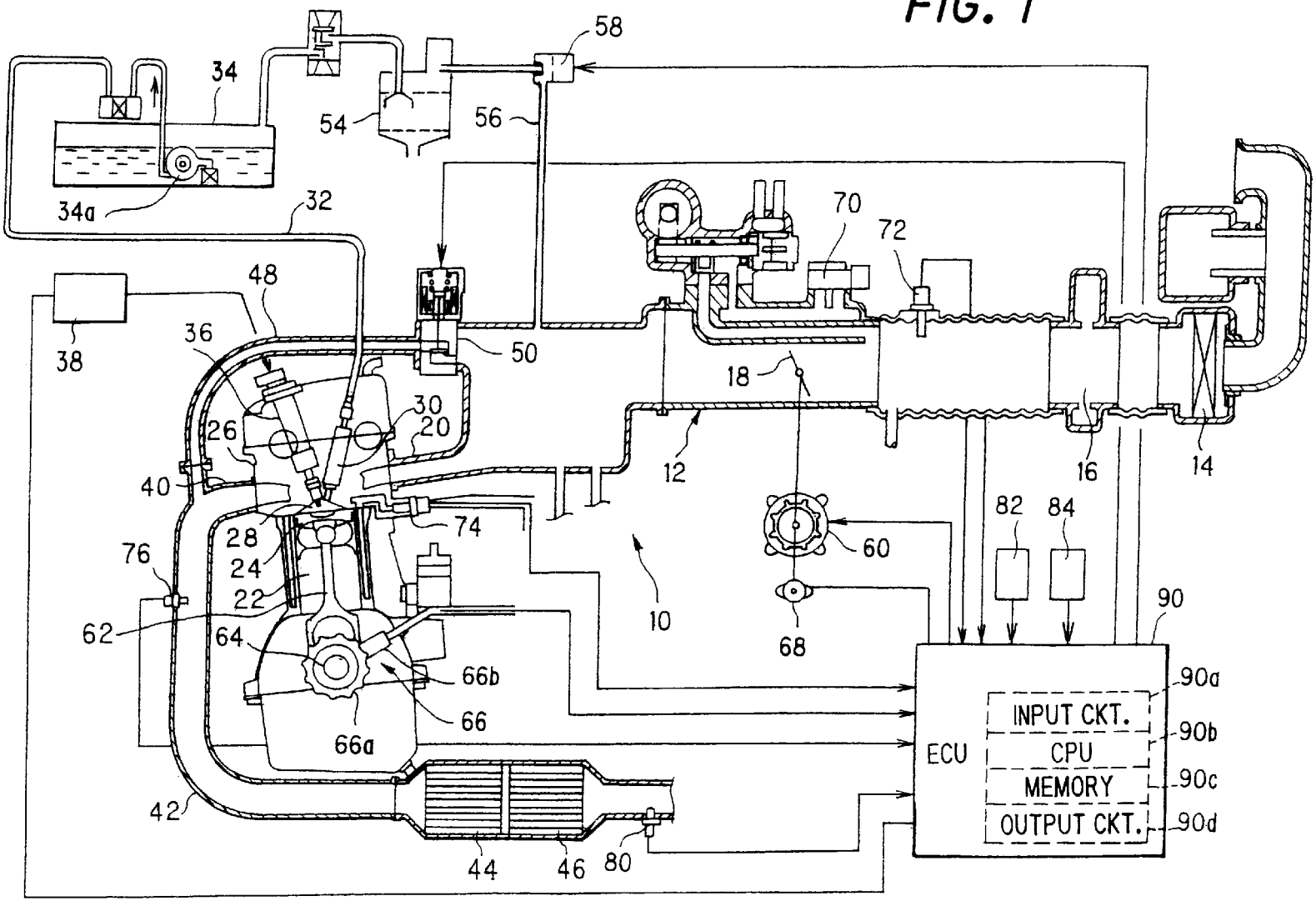
FIG. 1 is an overall schematic view showing a cylinder air/fuel ratio estimation system of an internal combustion engine according to an embodiment of the invention.

FIG. 1 is an overall schematic view of a cylinder air/fuel ratio estimation system of an internal combustion engine according to an embodiment of the invention.

Reference numeral 10 in this figure designates an OHC in-line four-cylinder internal combustion engine. Air drawn into an air intake pipe 12 through an air cleaner 14 mounted on its far end flows through a surge tank 16 and an intake manifold 20, while the flow thereof is adjusted by a throttle valve 18, to two intake valves (neither shown) of respective one of the first (#1) to fourth (#4) cylinders 22 (for brevity of illustration, only one is shown in the figure).

Each cylinder 22 has a piston 24 which is displaceable in the cylinder 22. The top of the piston 24 is recessed such that a combustion chamber 28 is formed in a space defined by the recessed piston top and the inner wall of a cylinder head. A fuel injector 30 is provided in the vicinity of the center of the ceiling of the combustion chamber 28.

The fuel injector 30 is connected, via a fuel supply pipe 32, to a fuel tank 34 and is supplied with pressurized fuel (gasoline) which is pumped by a pump 34*a* and is pressurized to a predetermined level by a high-pressure pump and a regulator (neither shown). The fuel injector 30 injects fuel directly into the combustion chamber 28 when opened. The injected fuel mixes with the air and forms the air-fuel mixture.

A spark plug 36 is provided in the combustion chamber 28. The spark plug 36 is supplied with electric energy from an ignition system 38 including an ignition coil (not shown) and ignites the air-fuel mixture at a predetermined ignition timing in the order of the first, the third, the fourth and the second cylinder. The resulting combustion of the air-fuel mixture drives down the piston 24.

Thus, the engine 10 is a direct injection spark ignition multi-cylinder engine in which the gasoline fuel is directly injected into the combustion chamber 28 of respective cylinders 22 through the fuel injector 30.

The exhaust gas produced by the combustion is discharged through two exhaust valves (neither shown) into an exhaust manifold 40, from where it passes through an exhaust pipe 42 to a catalytic converter 44 (for removing NOx in the exhaust gas) and a second catalytic converter 46 (three-way catalyst for removing NOx, CO and HC in the exhaust gas) to be purified and then flows out of the engine 10.

The exhaust pipe 42 is connected, at a location downstream of the confluence point of the exhaust manifold 40, to the air intake pipe 12 by an EGR conduit 48, at a position downstream of the throttle valve 18, so as to recirculate the exhaust gas partially in the operation of EGR (Exhaust Gas Recirculation). An EGR control valve 50 is provided at the EGR conduit 48 and is opened to recirculate a part of the exhaust gas at predetermined engine operating conditions, while regulating the flow rate of exhaust gas recirculation (EGR amount).

A canister 54 is installed and is connected to a space above the fuel level of the fuel tank 34 such that vaporized fuel is supplied to the canister 54 and is trapped in the activated charcoal filled in the canister 54. The canister 54 is connected through a purge pipe 56 to the air intake pipe 12, at a location downstream of the throttle valve 18. A canister control valve 58 is provided at the purge pipe 56 and is opened to purge a part of the vaporized fuel at predetermined engine operating conditions, while regulating the flow rate of purge (purge flow rate).

The throttle valve 18 is not mechanically linked with an accelerator pedal (not shown) installed at the floor of a vehicle operator seat (not shown), but is connected to a stepper motor 60 to be driven by the motor to open/close the air intake pipe 12. The throttle valve 18 is operated in such a DBW (Drive-By-Wire) fashion.

The piston 24 is connected to a crankshaft 64 through a connecting rod 62 to rotate the same. A crank angle sensor 66 is installed in the vicinity of the crankshaft 64, which comprises a pulser 66*a* fixed to the rotating crankshaft 64 and an electromagnetic pickup 66*b* fixed in an opposing stationery position. The crank angle sensor 66 generates a cylinder discrimination signal (named "CYL") once every 720 crank angular degrees, a signal (named "TDC" (Top Dead Center)) at a predetermined BTDC crank angular position and a unit signal (named "CRK") at 30 crank angular degrees (named "STAGE") obtained by dividing the TDC signal intervals by six.

A throttle position sensor 68 is connected to the stepper motor 60 and generates a signal indicative of the opening degree of the throttle valve 18 (named "TH"). A manifold absolute pressure (MAP) sensor 70 is provided in the air intake pipe 12 downstream of the throttle valve 18 and generates a signal indicative of the engine load, more precisely the absolute manifold pressure (named "PBA") generated by the intake air flow there through a conduit (not shown).

An intake air temperature sensor 72 is provided at a location upstream of the throttle valve 18 and generates a signal indicative of the temperature of intake air (named "TA"). And a coolant temperature sensor 74 is installed in the vicinity of the cylinder 22 and generates a signal indicative of the temperature of an engine coolant (named "TW").

Further, a universal (or wide range) sensor (air/fuel ratio sensor) 76 is installed at the exhaust pipe 42 at a position upstream of the catalytic converters 44, 46 and generates a signal indicative of the exhaust air/fuel ratio that changes linearly in proportion to the oxygen concentration in the exhaust gas. This sensor 76 is hereinafter referred to as "LAF" sensor.

Figure 2:
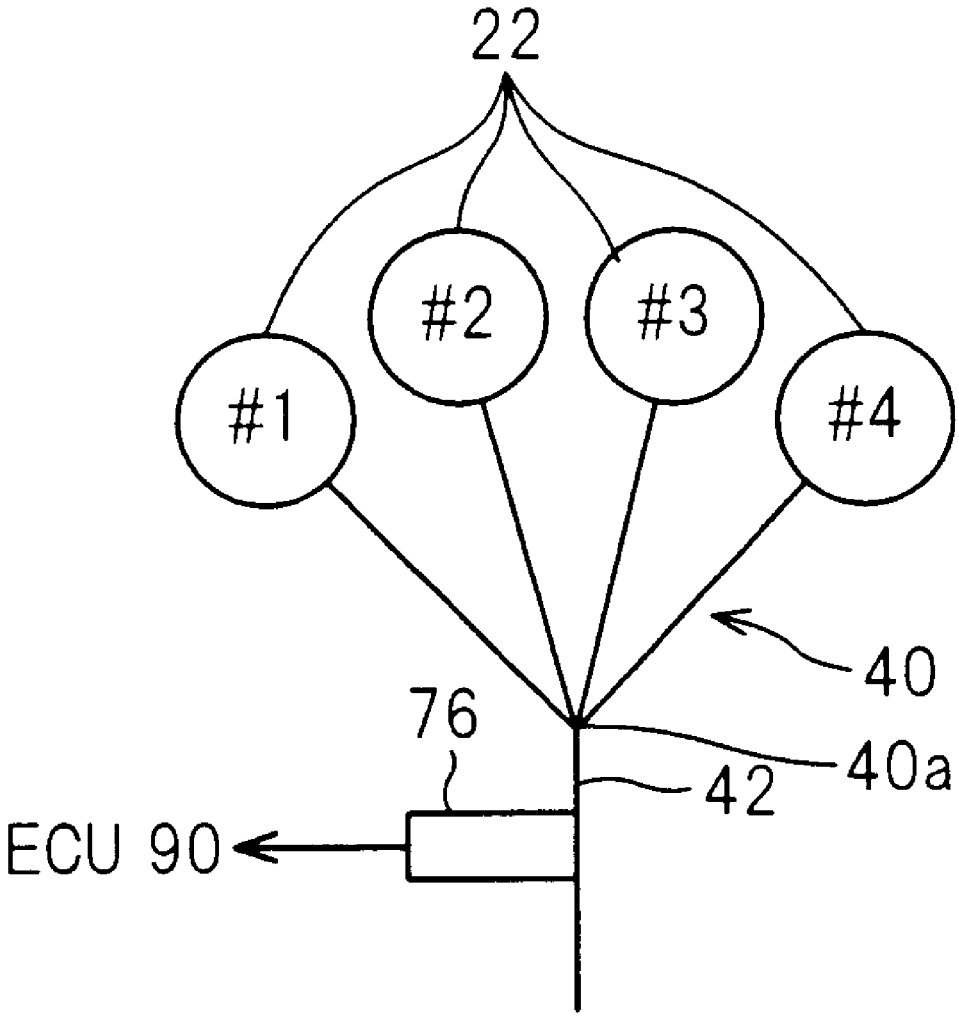
FIG. 2 is a schematic view showing where an air/fuel ratio sensor (LAF sensor) is installed relative to the exhaust manifold of the engine illustrated in FIG. 1.

As schematically illustrated in FIG. 2, only one LAF sensor 76 is installed at a position downstream of a confluence point 40*a* of the exhaust manifold 40 and generates the signal indicative of the air/fuel ratio in the gases exhausted from the cylinders 22 of the engine 10.

In addition, an $O_2$ sensor (air/fuel ratio sensor) 80 is provided at a position downstream of the catalytic converters 44, 46 and generates a signal which changes each time the exhaust air/fuel turns from lean to rich and vice versa with respect to a stoichiometric air/fuel ratio.

Furthermore, an accelerator position sensor 82 is provided in the vicinity of the accelerator pedal which generates a signal indicative of the position (opening degree) of the accelerator pedal (named "θ AP"). And an atmospheric pressure sensor 84 is installed at an appropriate location of the engine 10 and generates a signal indicative of the atmospheric pressure (named "PA") of the place where a vehicle on which the engine 10 is mounted runs.

The outputs of the sensors are sent to an ECU (Electronic Control Unit) 90. The ECU 90 comprises a microcomputer having an input circuit 90*a*, a CPU 90*b*, a memory (ROM, RAM, etc.) 90*c*, an output circuit 90*d* and a counter (not shown). The CRK signal generated by the crank angle sensor 66 is counted by the counter and the engine speed NE is detected or calculated.

The outputs of the LAF sensor 76 is successively sampled (i.e. A/D converted) at every STAGE and is stored in the memory 90*c*. The STAGE is 30 crank angle degrees as mentioned above and the STAGEs in TDC intervals are assigned with a number (named "STAGE No.") and are identified with each other.

The ECU 90 determines or calculates the fuel injection amount and the ignition timing based on the detected engine speed NE and the inputted sensor outputs.

Explaining the fuel injection amount determination, the ECU 90 determines or calculates a desired engine torque PME indicative of the engine load (or the output required by the vehicle operator) based on the detected engine speed NE and the accelerator pedal position θ AP. Then, the ECU 90 selects or determines one of the aforesaid operation modes of the engine 10 based on the determined desired engine torque PME and the detected engine speed NE. The ECU 90 further determines or calculates the desired air/fuel ratio KCMD based on the determined desired engine torque PME and the detected engine speed NE.

Specifically, when the determined desired engine torque PME falls in the region of high engine load, the ECU 90 determines the operation mode (hereinafter referred to as "ST.EMOD") as the stoichiometric air/fuel ratio operation mode ("ST.EMOD=0; a first operation mode) in which the desired air/fuel ratio KCMD is determined to be the stoichiometric air/fuel ratio or thereabout, more specifically in a range from 12.0:1 to 15.0:1.

When the determined desired engine torque PME falls in the region of medium engine load, the ECU 90 determines the operation mode ST.EMOD as the pre-mixture combustion operation mode ("ST.EMOD=1; a second operation mode) in which the desired air/fuel ratio KCMD is determined to be an air/fuel ratio leaner than the stoichiometric air/fuel ratio, more specifically in a range from 15.0:1 to 22.0:1.

And, when the determined desired engine torque PME falls in the region of low engine load, the ECU 90 determines the operation mode ST.EMOD as the stratified combustion operation mode ("ST.EMOD=2; third operation mode) in which the desired air/fuel ratio KCMD is determined to be an air/fuel ratio leaner than that in the pre-mixture combustion operation mode, more specifically in a range from 22.0:1 to 60.0:1. Thus, the engine 10 is configured to have two kinds of a lean-burn combustion operation modes comprising the pre-mixture combustion operation mode and the stratified combustion operation mode.

When the stoichiometric air/fuel operation mode or the pre-mixture combustion operation is selected, the fuel is injected during the intake stroke. The injected fuel mixes with the intake air and is ignited to produce the pre-mixture charged combustion (uniform combustion). When the stratified combustion operation mode is selected, the fuel is injected during the compression stroke (and sometimes partially injected at the intake stroke) and produces the stratified charged combustion (more precisely, the Direct Injecting Stratified Charged combustion or diffusion combustion).

It should be noted that the operation mode (indicative of the engine load) is determined based on the detected engine speed NE and the calculated desired engine torque PME, but the fuel injection should be always effected such that the actual air/fuel ratio in the vicinity of the spark plug 36 falls within a range from 12.0:1 to 15.0:1, whichever operation mode is selected.

The ECU 90 determines or calculates a basic fuel injection amount TIM, in terms of an opening period of the fuel injector 30, based on the detected engine speed NE and the manifold absolute pressure PBA. The ECU 90 then determines or calculates an output fuel injection amount TOUT based on the values thus determined, as follows:

$$TOUT=TIM\times KCMDM\times KAF\times KT+TT$$

In the above, KCMDM indicates a desired air/fuel ratio correction coefficient and is obtained by correcting the aforesaid desired air/fuel ratio KCMD by the charging efficiency. It should be noted that the desired air/fuel ratio KCMD and the desired air/fuel ratio correction coefficient KCMDM are expressed, in fact, as the equivalence ratio. KAF indicates an air/fuel ratio feedback correction coefficient based on the output of the LAF sensor 76 (explained later). KT is the product of the other correction coefficients in multiplication form and TT is the sum of the other correction factors in additive form.

Explaining the ignition timing determination, the ECU 90 determines or calculates a basic ignition timing IGMAP based on the detected engine speed NE and the calculated desired engine torque PME in the stratified combustion operation mode, and determines or calculates the same based on the detected engine speed NE and the manifold absolute pressure PBA in the pre-mixture combustion operation mode and the stoichiometric air/fuel ratio operation mode.

Then, the ECU 90 determines or calculates an output ignition timing IG as follows:

$$IG=IGMAP+IGCR$$

In the above, IGCR indicates the sum of correction factors including an engine coolant temperature correction factor IGTW.

Then, the ECU 90 outputs a signal to the ignition system 38 and the spark plug 36 to ignite the air-fuel mixture at a crank angular position corresponding to the determined output ignition timing IG.

The operation of the cylinder air/fuel ratio estimation system of an internal combustion engine according to the embodiment will be explained.

Figure 3:
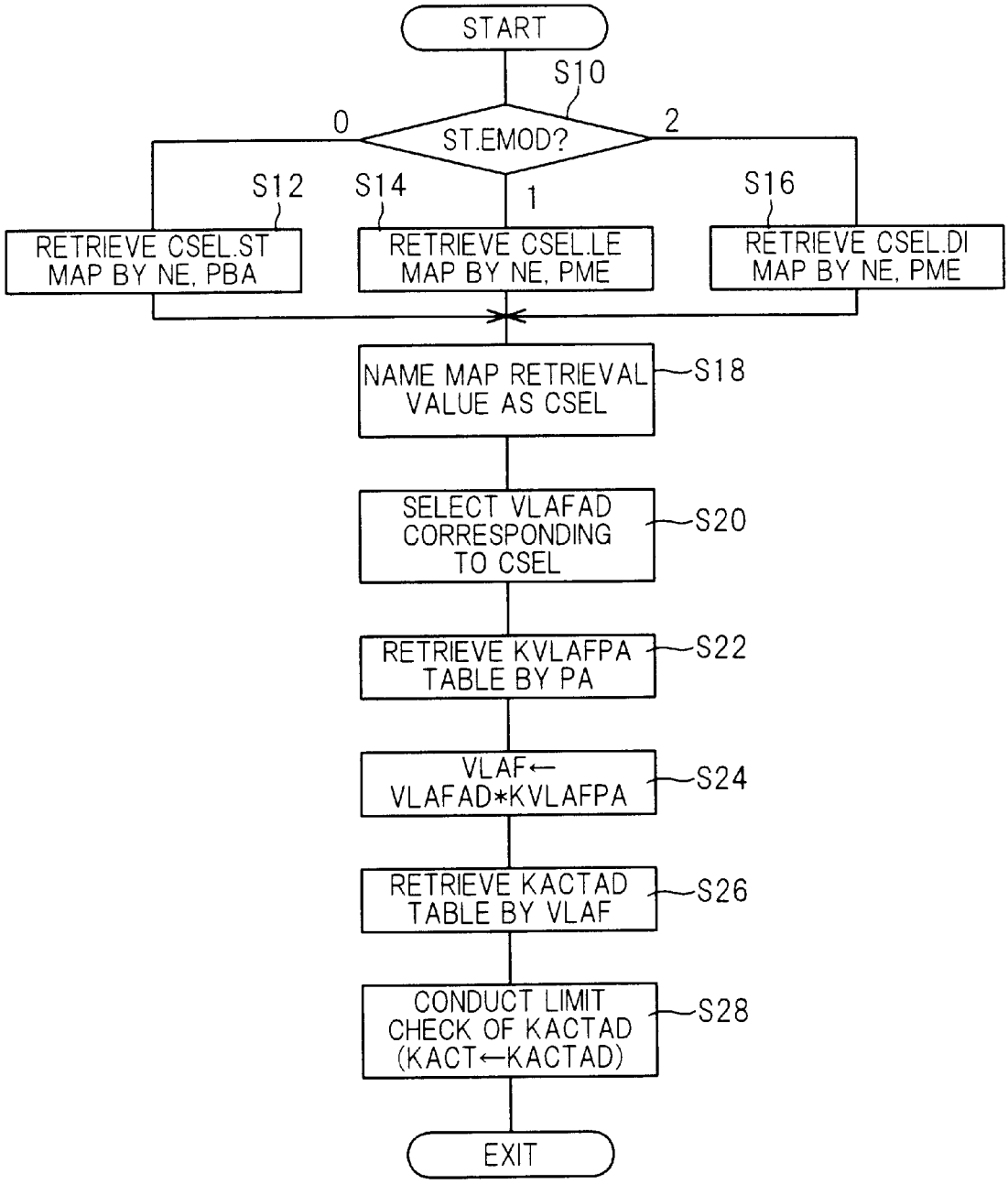
FIG. 3 is a flow chart showing the operation of the system illustrated in FIG. 1.

FIG. 3 is a flow chart showing the operation of the system. The program illustrated there is executed at a predetermined crank angular position near Top Dead Center of each cylinder 22 of the engine 10 and the air/fuel ratio at each cylinder is estimated.

Before entering into the explanation of the figure, the air/fuel ratio estimation technique proposed earlier by the assignee will be outlined.

As mentioned above, the assignee proposes, in U.S. Pat. No. 5,524,598, estimating the air/fuel ratio at each cylinder with the use of an observer. The observer inputs the known controlled variables and measured values and estimates or calculates a state variable which can not be measured outside of the system. In the technique, the assignee assumes that the air/fuel ratio at the confluence point 40*a* of the exhaust manifold 40 is a mixture of the air/fuel ratios exhausted from the four cylinders and the degree of contribution of each cylinder to the confluence point air/fuel ratio would periodically change. Based thereon, the assignee identifies the air/fuel ratio (A/F) of one exhausting cylinder at time k as X(k) and models the behavior of the exhaust manifold 40 as Eq. 1.

$$\begin{pmatrix} X(k-2) \\ X(k-1) \\ X(k) \\ X(k+1) \end{pmatrix} = \begin{pmatrix} 0 & 1 & 0 & 0 \\ 0 & 0 & 1 & 0 \\ 0 & 0 & 0 & 1 \\ 1 & 0 & 0 & 0 \end{pmatrix} \begin{pmatrix} X(k-3) \\ X(k-2) \\ X(k-1) \\ X(k) \end{pmatrix} \quad \text{Eq. 1}$$

It is assumed in Eq. 1 that X(k+1)=X(k−3), i.e. the air/fuel ratio at the same cylinder remains unchanged during this period of time. The highest degree of contribution (i.e. the weight coefficient) of the cylinder is named EXMC4, and the others are named EXMC3, EXMC2, EXMC1 in the order of degree of contribution. The sum of the degree of contribution is determined to be 1.0. Then, the output Y(k) indicative of the confluence point air/fuel ratio is expressed as a weight-average as shown in Eq. 2.

$$Y(k) = [EXMC1 \quad EXMC2 \quad EXMC3 \quad EXMC4] \begin{pmatrix} X(k-3) \\ X(k-2) \\ X(k-1) \\ X(k) \end{pmatrix} \quad \text{Eq. 2}$$

Thus, the LAF sensor output can be assumed a weight-average obtained by multiplying the past firing histories of the respective cylinders by the weight coefficient (EXMCn or C (explained later)).

Modeling the behavior of the LAF sensor 76 as a first-order lag model whose first-order lag coefficient is TDLAF, it can be expressed as Eq. 3.

$$KACTHAT(k)=TDLAF\times KACTHAT(k-1)+(1-TDLAF)\times \text{exhaust } A/F(k) \quad \text{Eq. 3}$$

Figure 4:
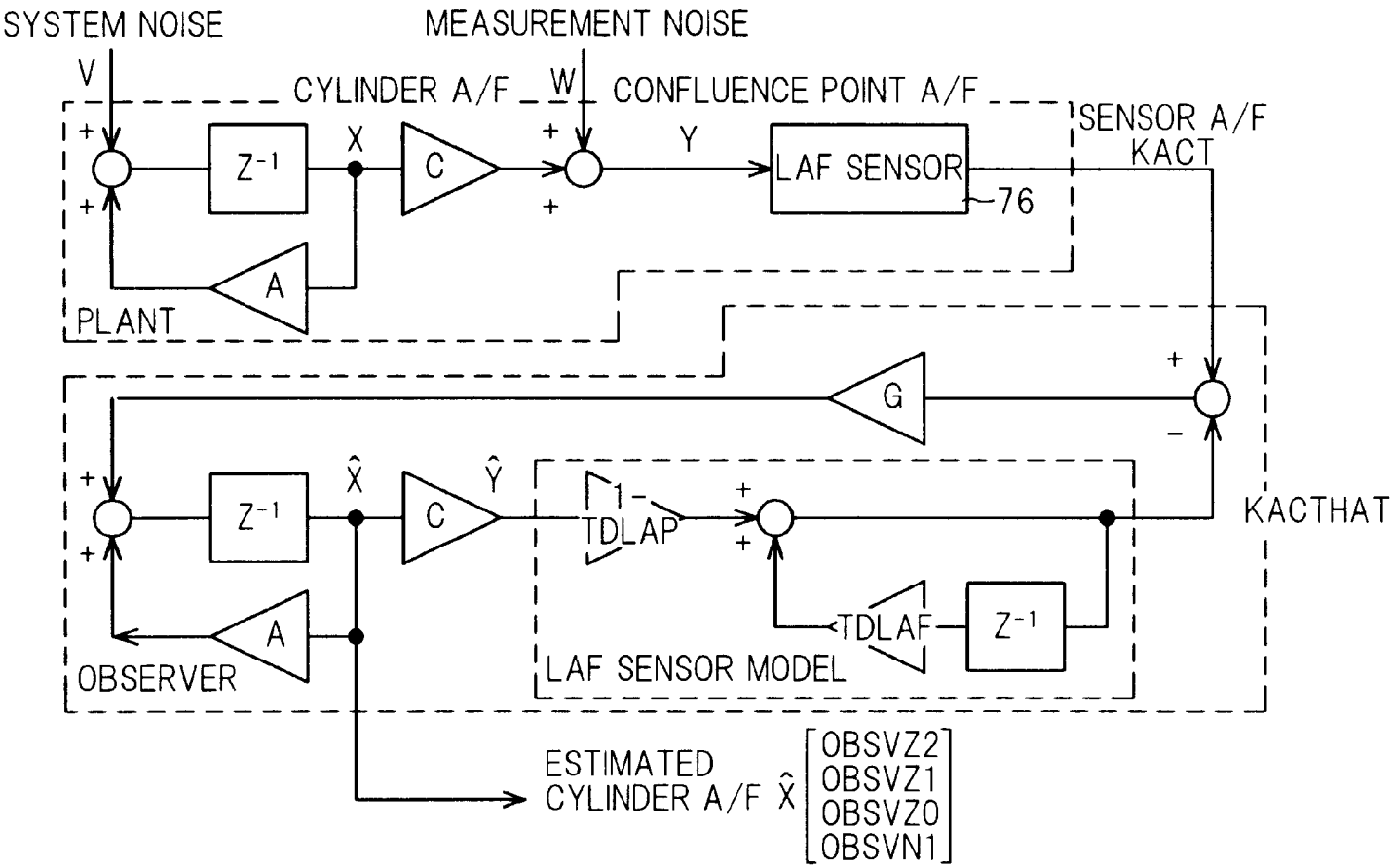
FIG. 4 is a block diagram showing an observer and a model describing the behavior of the exhaust manifold of the engine illustrated in FIG. 1.

The observer and the model of the exhaust manifold can be expressed by a block diagram illustrated in FIG. 4. In the figure, OBSVZ2, OBSVZ1, OBSVZ0, OBSVN1 are estimated air/fuel ratios of the respective cylinders. Specifically, OBSVZ2 is that of the cylinder exhausted at two cycles earlier, OBSVZ1 is that of the cylinder exhausted at one cycle earlier, OBSVZ0 is that of the cylinder currently exhausting and OBSVN1 is that of the cylinder which exhaust next. These estimated air/fuel ratios at the time (k) can be determined or obtained by the observer matrix calculations expressed in Eqs. 4 and 5.

In Eq. 5, the coefficient A is a matrix having the number of orders corresponding to the number of cylinders and is expressed by Eq. 6.

$$A = \begin{pmatrix} 0 & 1 & 0 & 0 \\ 0 & 0 & 1 & 0 \\ 0 & 0 & 0 & 1 \\ 1 & 0 & 0 & 0 \end{pmatrix} \quad \text{Eq. 6}$$

Further, in Eq. 4, the coefficient C is a matrix indicative of the exhaust manifold mixture model (i.e. weight coefficient) shown in Eq. 2 and is expressed as Eq. 7.

$$C=[EXMC1 EXMC2 EXMC3 EXMC4] \quad 7$$

Furthermore, in Eq. 5, the coefficient G is an observer gain matrix shown in Eq. 8 and can be obtained by solving a Ricatti's equation as shown in Eq. 9.

$$G = \begin{pmatrix} GOBSV1 \\ GOBSV2 \\ GOBSV3 \\ GOBSV4 \end{pmatrix} \quad \text{Eq. 8}$$

$$G=f(A,C,Q,R) \quad \text{Eq. 9}$$

In Eq. 9, Q, and R are variables to be used in designing the system and are expressed, for example, as Eq. 10.

$$Q = \begin{pmatrix} q & 0 & 0 & 0 \\ 0 & q & 0 & 0 \\ 0 & 0 & q & 0 \\ 0 & 0 & 0 & q \end{pmatrix}, R = 1 \quad \text{Eq. 10}$$

In the configuration shown in FIG. 4, when naming the estimated air/fuel ratio at the first cylinder (#1 cylinder) to the fourth cylinder (#4 cylinder) KACTOBSV1 to KACTOBSV4, they are calculated from the aforesaid estimated air/fuel ratio of the cylinder currently exhausting OBSVZ0 as follows;

KACTOBSV1=OBSVZ0(k)

KACTOBSV2=OBSVZ0(k)

KACTOBSV3=OBSVZ0(k)

KACTOBSV4=OBSVZ0(k)

Further, the assignee proposes, in U.S. Pat. No. 5,600,056, sampling the sensor output successively and selecting one from among the sampled data by retrieving mapped data by engine operation parameters, and proposes in U.S. Pat. No. 5,548,514, selecting and using one from among a plurality of observer gain matrices from by similar engine operation parameters.

$$KACTHAT(k) = TDLAF \times KACTHAT(k-1) + (1-TDLAF) \times C \times \begin{pmatrix} OBSVZ2(k) \\ OBSVZ1(k) \\ OBSVZ0(k) \\ OBSVN1(k) \end{pmatrix} \quad \text{Eq. 4}$$

$$\begin{pmatrix} OBSVZ2(k+1) \\ OBSVZ1(k+1) \\ OBSVZ0(k+1) \\ OBSVN1(k+1) \end{pmatrix} = A \times \begin{pmatrix} OBSVZ2(k) \\ OBSVZ1(k) \\ OBSVZ0(k) \\ OBSVN1(k) \end{pmatrix} + G \times (KACT(k) - KACTHAT(k)) \quad \text{Eq. 5}$$

Based on the above, the operation of the system will be explained with reference to the flow chart of FIG. 3.

The program begins in S10 in which it is determined which operation mode is selected or determined from the number of the aforesaid value ST.EMOD. When ST.EMOD is determined to be 0, the program proceeds to S12 in which one from among predetermined characteristics (mapped data) prepared beforehand is retrieved using the engine speed NE and the manifold absolute pressure PBA in the detected engine operating conditions as address data. More specifically, mapped data named CSEL.ST map is selected and is retrieved from the parameters.

When ST.EMOD is determined to be 1, the program proceeds to S14 in which one from among predetermined characteristics (mapped data) prepared beforehand is retrieved using the engine speed NE and the desired engine torque PME as address data. More specifically, mapped data named CSEL.LE map is selected and is retrieved from the parameters. When ST.EMOD is determined to be 2, the program proceeds to S16 in which one from among predetermined characteristics (mapped) prepared beforehand is retrieved using the engine speed NE and the desired engine torque PME as address data. More specifically, mapped data named CSEL.DI map is selected and is retrieved from the parameters.

The program then proceeds to S18 in which the value obtained by map retrieval is named CSEL, and to S20 in which one from among the sampled data VLAFAD (of the LAF sensor outputs successively sampled (A/D converted) and stored in the memory 90*c*) corresponding to CSEL is selected.

FIG. 5 is an explanatory view showing the configuration of the CSEL.ST map. Although not shown, those of the other CSEL.LE map and CSEL.DI map are similar to that shown in FIG. 5. The value CSEL obtained by map retrieval indicates a delay (time lag) from a time at which the exhaust gas is generated to a time at which it reaches or arrives the LAF sensor 76 (more precisely, to a time at which the LAF sensor 76 responds to generate the output upon arrival of the exhaust gas).

This is because the exhaust gas travel time to the LAF sensor varies with the engine operating conditions as mentioned above.

Figure 6:
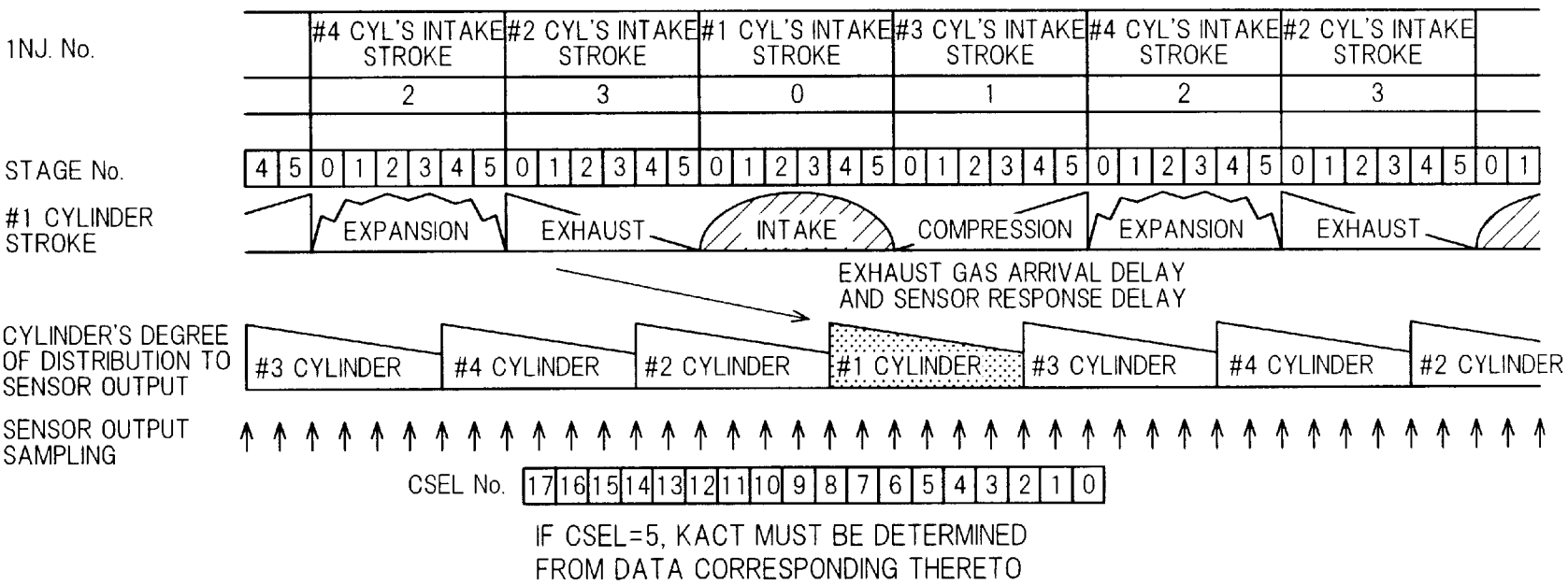
FIG. 6 is a time chart showing the delay until the generated exhaust gas reaches the air/fuel ratio sensor (LAF sensor)

FIG. 6 is a time chart showing the delay until the generated exhaust gas has reached or arrived the LAF sensor 76. When noticing the first cylinder (#1 cylinder), the gas exhausted at its exhaust stroke reach or arrives the LAF sensor 76 with a lag (in time or crank angles) as shown by the arrow. In addition to this travel delay, the response delay of the LAF sensor 76 should also be taken into account. Assuming the hatched portion in the figure is the sample data in which the degree of distribution of the first cylinder to the confluence point air/fuel ratio is maximum, this must correctly be selected.

Accordingly, the LAF sensor outputs successively sampled at every STAGE are numbered by CSEL (more precisely, CSEL No.) to be identified. As mentioned above, CSEL (more precisely, CSEL No.) has been prepared as the three kinds of maps in such a way that one of the maps is selected and is to be retrieved from the selected map by the engine speed NE and the manifold absolute pressure PBA (or desired engine torque PME).

Moreover, the exhaust gas arrival (travel) time varies with the engine operating conditions, as mentioned repeatedly. Discussing manifold absolute pressure PBA as the engine load (i.e. not the desired engine torque PME), if the manifold absolute pressure PBA is the same, the fuel amount decreases as the operation mode changes from the stoichiometric air/fuel ratio operation mode to the pre-mixture combustion operation mode, and from the pre-mixture combustion operation mode to the stratified combustion operation mode.

The exhaust gas temperature drops and hence the exhaust gas volume after combustion decreases with decreasing fuel amount. The time until the exhaust gas reaches the LAF sensor 76 will accordingly be longer. This indicates that the sensor output data sampled at a later stage must be selected. Saying this more specifically with reference to FIG. 6, a value in the right direction, a lesser value in terms of CSEL must be selected.

On the other hand, discussing this from the desired engine torque PME, if the desired engine torque PME is the same, the fuel amount is considered to be almost the same, whichever operation mode is selected. However, the manifold absolute pressure PBA is different and increases as the operation mode changes from the stoichiometric air/fuel ratio operation mode to the pre-mixture combustion operation mode, and from the pre-mixture combustion operation mode to the stratified combustion operation mode. This means that exhaust gas volume after combustion increases.

Thus, discussing this from the desired (engine) torque PME, the exhaust gas volume increases and hence the exhaust gas arrival time becomes shorter as the operation mode changes from the stoichiometric air/fuel ratio operation mode to the pre-mixture combustion operation mode, and from the pre-mixture combustion operation mode to the stratified combustion operation mode.

Figure 7A:
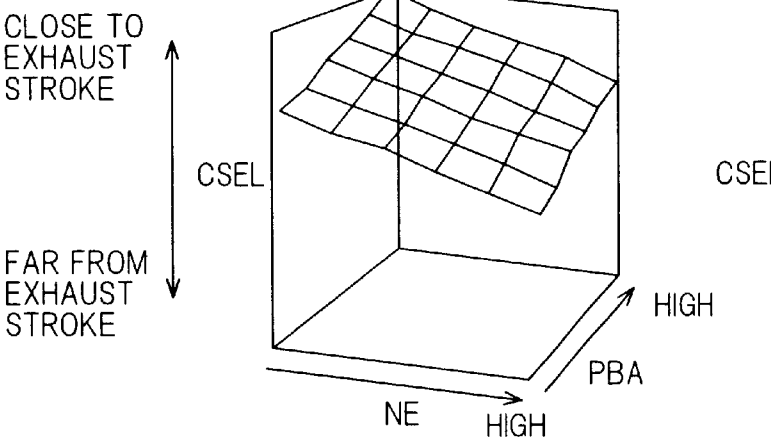
FIGS. 7A to 7C are a set of graphs showing the characteristics of the CSEL.ST map, CSEL.LE map and CSEL.DI map referred to in the flow chart of FIG. 3.
Figure 7B:
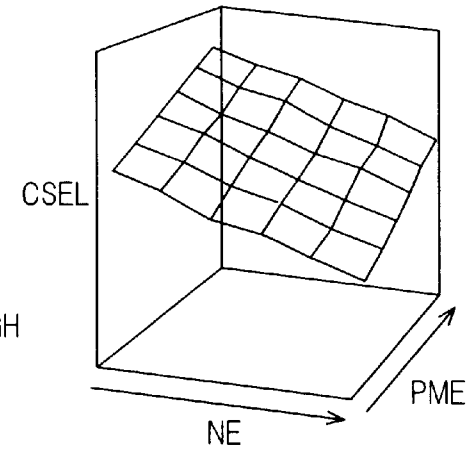
Figure 7C:
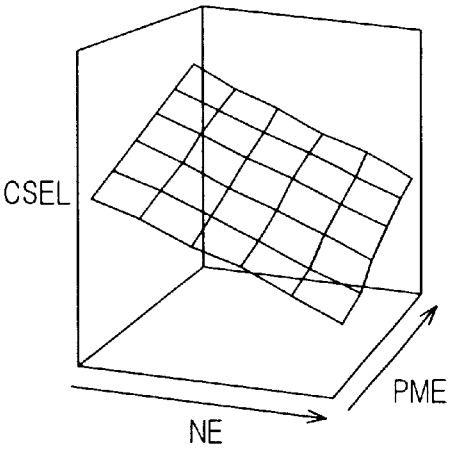

In this embodiment, in view of the above, the characteristic of the map shown in FIG. 5 is determined to be as illustrated in FIGS. 7A, 7B and 7C. FIG. 7A shows the characteristic of the CSEL.ST map, FIG. 7B shows that of the CSEL.LE map and FIG. 7C shows that of the CSEL.DI map. Specifically, CSEL (more precisely, CSEL No) is set to be decreased, in other words, it is set such that a data sampled at a later stage (in time) is selected as the operation mode changes from the stoichiometric air/fuel ratio operation mode to the pre-mixture combustion operation mode, and from the pre-mixture combustion operation mode to the stratified combustion operation mode.

It should also be noted that CSEL (more precisely, CSEL No.) is set to be increased with decreasing engine speed and with increasing engine load (manifold absolute pressure PBA) in such a way that a data sampled at an earlier stage is selected.

Figure 8:
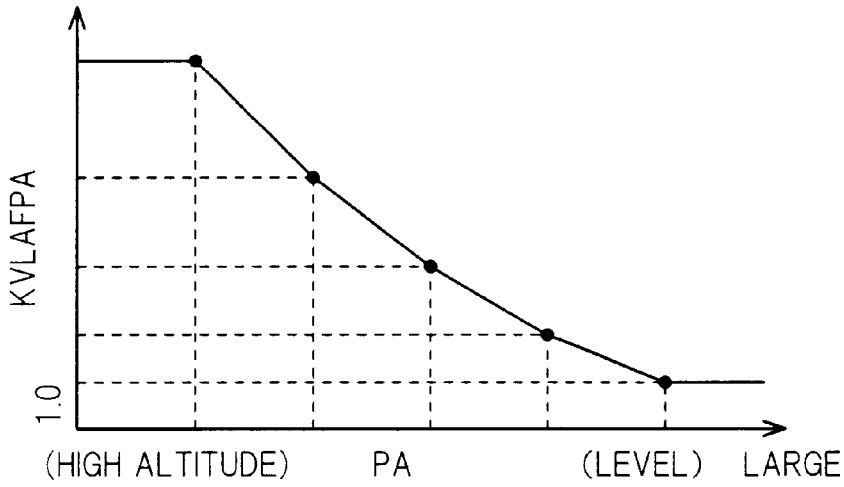
FIG. 8 is a graph showing the characteristic of a KVLAFPA table referred to in the flow chart of FIG. 3.

Returning to the explanation of FIG. 3, the program then proceeds to S20 in which a sampled data VLAFAD corresponding to CSEL is selected. The program then proceeds to S22 in which an atmospheric correction coefficient KVLAFPA is calculated by retrieving a KVLAFPA table (whose characteristic is shown in FIG. 8) by the detected atmospheric pressure PA, and to S24 in which the selected sampled data VLAFAD is multiplied by the retrieved coefficient and the product obtain is named VLAF.

Figure 9:
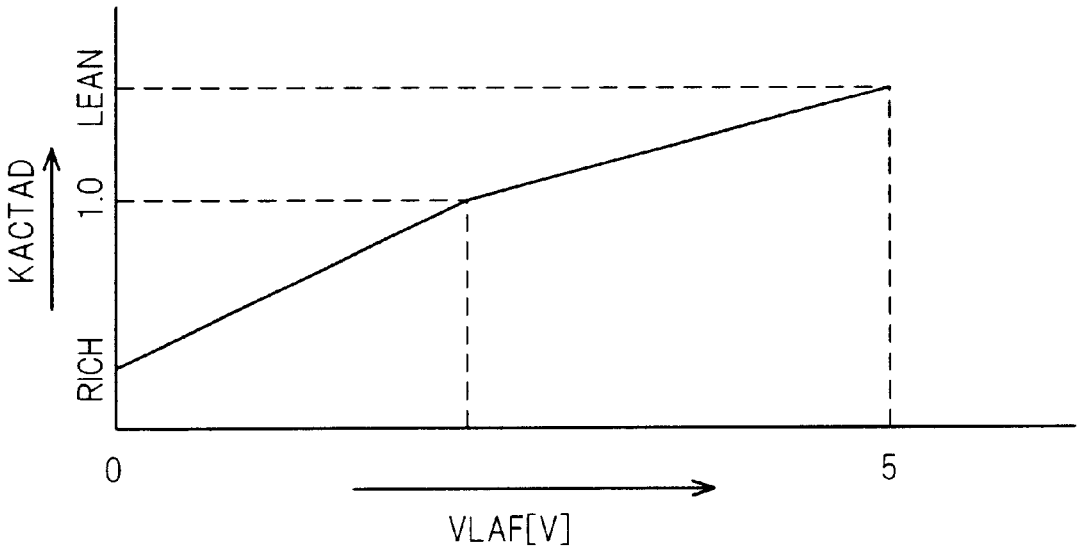
FIG. 9 is a graph showing the characteristic of a KACTAD table referred to in the flow chart of FIG. 3.

The program then proceeds to S26 in which a value KACTAD is calculated by retrieving a KACTAD table (whose characteristic is shown in FIG. 9) by the calculated value VLAF.

The program then proceeds to S28 in which it is determined whether the calculated value KACTAD is within a range defined by appropriately set upper limit and a lower limit and when the result is affirmative, the calculated value KACTAD is named KACT. On the other hand, when the result is negative, the calculated value KACTAD is replaced by the upper limit or the lower limit concerned and the replaced value is named KACT.

As illustrated in FIG. 9, the value KACT thus determined indicates the air/fuel ratio proportional to the oxygen concentration in the exhaust gas as the stoichiometric air/fuel ratio (equivalence ratio; 1.0) or a specific air/fuel ratio richer or leaner than the stoichiometric value. The value KACT thus determined corresponds to the "exhaust A/F" in Eq. 3. Using Eq. 3, the estimated value KACTHAT(k) is calculated and then using the calculated value, the estimated air/fuel ratio in a cylinder concerned KACTOBSn (n: 1 to 4) is calculated in accordance with Eqs. 4 and 5.

Then, the error or difference between the estimated air/fuel ratio in a cylinder concerned and the desired air/fuel ratio KCMD is determined or calculated. The PID gains are multiplied to the error and the aforesaid air/fuel ratio feedback correction coefficient KAF is determined or calculated. The basic fuel injection amount TIM is multiplied by the coefficient (with the other coefficients) and the output fuel injection amount TOUT is determined or calculated such that the estimated air/fuel ratio KACT converges to the desired air/fuel ratio KCMD.

Having been configured in the foregoing manner, the system according to this embodiment can improve the accuracy of the observer cylinder air/fuel ratio estimation by appropriately selecting one from among the sampled data of the air/fuel ratio sensor outputs, for the selected one of the operation modes including the stoichiometric air/fuel ratio operation mode, the pre-mixture combustion operation mode and the stratified combustion operation mode, thereby enabling to estimate the air/fuel ratio of each cylinder with accuracy. With this, it becomes possible to conduct an accurate cylinder air/fuel ratio control.

Figure 10:
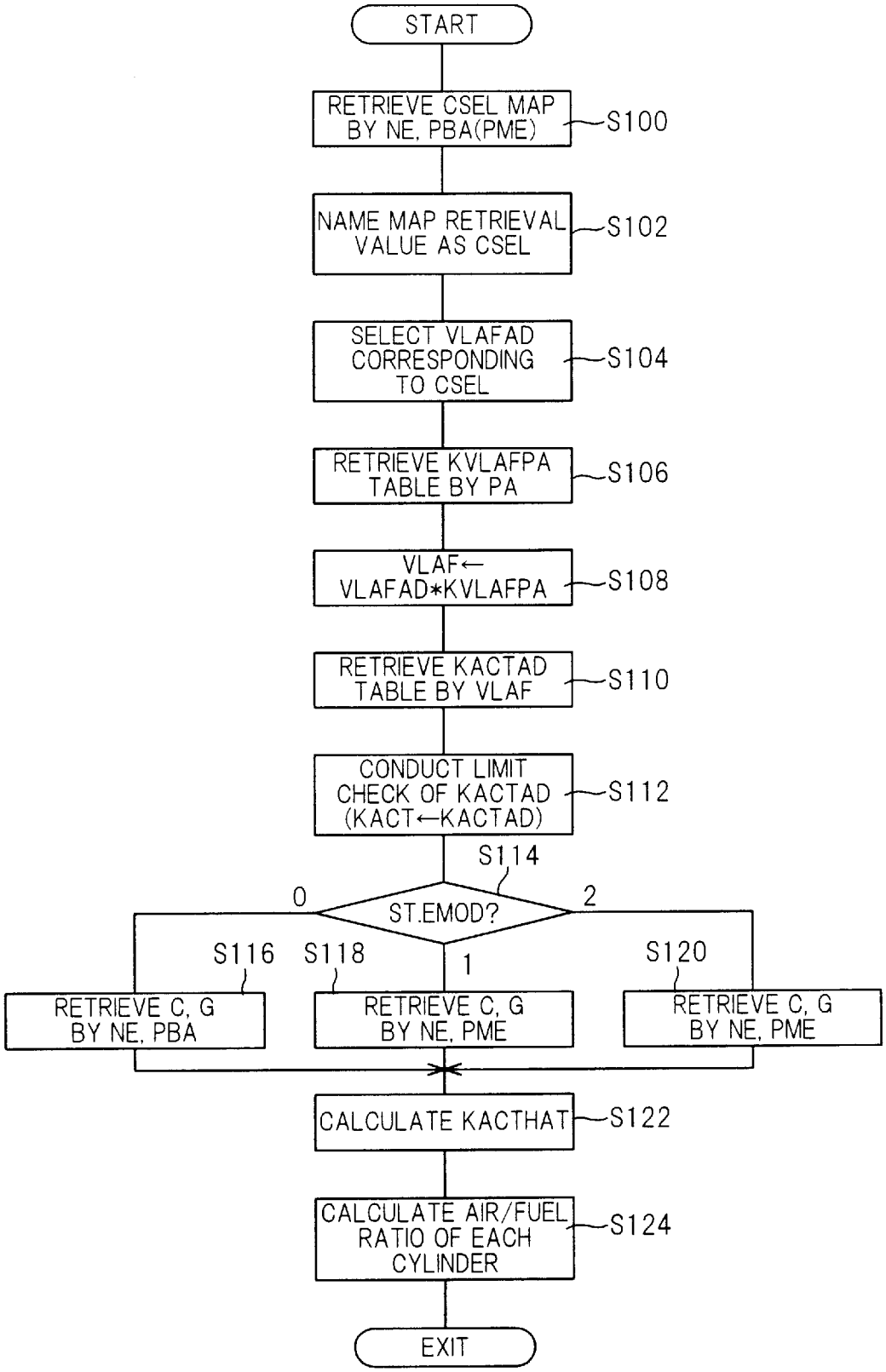
FIG. 10 is a flow chart, similar to FIG. 3, but showing the operation of a cylinder air/fuel ratio estimation system of an internal combustion engine according to a second embodiment of the invention.

FIG. 10 is a flow chart, similar to FIG. 3, but showing the operation of a cylinder air/fuel ratio estimation system of an internal combustion engine according to a second embodiment of the invention.

In the second embodiment, the exhaust gas mixture model matrix C (weight coefficient; expressed in Eq. 7) and the observer gain matrix G (expressed in Eq. 8) are set to be different for different operation modes. Specifically, the first embodiment is configured such that one of the three kinds of CSELmaps is selected in response to the selected operation mode and one from among the sampled data is selected by CSEL retrieved from the selected map. The second embodiment is configured such that the exhaust gas mixture model matrix C and the observer gain matrix G are set to be different for different operation modes, and the matrices C and G are selected in response to the selected operation mode.

More specifically, the fact the exhaust gas arrival time becomes longer as the operation mode changes from the stoichiometric air/fuel ratio operation mode to the pre-mixture combustion operation mode, and from the pre-mixture combustion mode to the stratified combustion mode, means that the influence of the cylinders exhausting before the current cylinder remains for a longer period.

Taking this into account, in the second embodiment, the matrices C and G are made different for the operation modes, more precisely, are made different for the operation modes and the engine operating conditions.

To be specific, the observer gain matrix G is solely determined from the exhaust gas mixture model coefficient C, as will be understood from Eq. 9. Accordingly, a plurality of combinations of C and G are prepared beforehand which are different for the operation modes and the engine operating conditions (defined by the engine speed NE and the manifold absolute pressure PBA (or desired engine torque PME)).

Explaining the operation of the system according to the second embodiment, the program begins in S100 in which a CSEL map (whose characteristic is similar to that shown in FIG. 7A) is retrieved by the engine speed NE and the manifold absolute pressure PBA (or desired engine torque PME).

The program then proceeds to S102 to S108 in the same manner as that in the first embodiment, and proceeds to S110 in which the KACTAD table is retrieved by the VLAF, and to S112 in which KACT is calculated. The program then proceeds to S114 in which it is determined which operation mode is selected, and proceeds to one of S116 to S120 based on the result of determination in which the matrices C and G are calculated by retrieving characteristics (not shown) by the engine speed NE and the manifold absolute pressure PBA (or desired engine torque PME).

The program then proceeds to S122 in which the value KACTHAT(k) is calculated using Eq. 4, and to S124 in which the estimated air/fuel ratio at a cylinder concerned KACTOBSn is calculated using Eq. 5.

Having been configured in the foregoing manner, the system according to the second embodiment can improve the accuracy of the observer cylinder air/fuel ratio estimation by appropriately selecting one from among the sampled data of the air/fuel ratio sensor outputs for the selected operation mode, thereby enabling to estimate the air/fuel ratio of each cylinder with accuracy and to conduct an accurate cylinder air/fuel ratio control.

The first and second embodiments are thus configured to have a system for estimating an air/fuel ratio of each cylinder (22) of an internal combustion engine (10) having a plurality of cylinders (22) which are connected to an exhaust system having an exhaust manifold (40), including: an air/fuel ratio sensor (LAF sensor 76) installed at or downstream of a confluence point **(40*a*) of the exhaust manifold (40) and generating an output indicative of an air/fuel ratio exhausted from the cylinders (22); air/fuel ratio sensor output sampling module (90) which A/D converting the output of the air/fuel ratio sensor (76) and stores successively as sampled data; engine operating condition detecting module (66, 70) which detects operating conditions of the engine including at least an engine speed (NE) and an engine load (PBA, PME); sampled data selecting module (90, S10–S28, S100–S124) which selects one from among the sampled data based on at least the engine speed (NE) and the engine load (PME) in the detected operating conditions of the engine, and estimates the air/fuel ratio of each cylinder (KACTOBSn) from the selected sampled data based on a model describing a behavior of the exhaust manifold and designed based on assumption that the output of the air/fuel ratio sensor comprises a weight-average obtained by multiplying past firing histories of the cylinders by a weight coefficient (C) and an observer for observing an internal state of the model. The system includes: operation mode selecting module (90, S10, S114)** which selects an operation mode of the engine (ST.EMOD) from at least a first operation mode (stoichiometric air/fuel ratio operation mode) in which a desired air/fuel ratio (KCMD) is set to be a stoichiometric air/fuel ratio, a second operation mode (pre-mixture combustion operation mode) in which the desired air/fuel ratio (KCMD) is set to be an air/fuel ratio leaner than the stoichiometric air/fuel ratio and a third operation mode (stratified combustion operation mode) in which the desired air/fuel ratio (KCMD) is set to be an air/fuel ratio leaner than that of the second operation mode (ST.EMOD); and the sampled data selecting module selects the one from among the sampled data based on at least the engine speed (NE), the engine load (PBA, PME) and the selected operation mode, and estimates the air/fuel ratio of each cylinder from the selected sample, based on the model and the observer, for the selected operation mode of the engine.

In the system, the sample data selecting module selects the one from among the sampled data in accordance with mapped data (CSEL.ST map, CSEL.LE map, CSEL.DI map) retrievable by the engine speed (NE), the engine load (PBA, PME) and the selected operation mode (ST.EMOD).

In the system, the sample data selecting module includes: a plurality of mapped data prepared corresponding to the first to the third operation modes of the engine; mapped data selecting module which selects one of the plurality of the mapped data (CSEL.ST map, CSEL.LE map, CSEL.DI map) in response to the selected operation mode (ST.EMOD); and mapped data retrieving module which retrieves the selected mapped data by the engine speed (NE) and the engine load (PBA, PME) to selects the one from among the sampled data; and estimates the air/fuel ratio of each cylinder from the selected sample, based on the model and the observer, for the selected operation mode of the engine.

In the system, the sample data selecting module includes: mapped data (CSEL map) prepared to the first to the third operation modes of the engine; mapped data retrieving module which retrieves the mapped data by the engine speed (NE) and the engine load (PBA, PME) to selects the one from among the sampled data; and model weight coefficient changing module which changes the weight coefficient of the model (C) and a gain matrix of the observer (G) in response to the selected operation mode (ST.EMOD); and estimates the air/fuel ratio of each cylinder from the selected sample, based on the changed coefficient of the model (C) and the changed gain matrix of the observer (G), for the selected operation mode of the engine (ST.EMOD).

In the system, the sampled data selecting module selects one from among the sampled data such that a data sampled later is selected as the operation mode (ST.EMOD) changes from the first to the second, the second to the third.

In the system, the sampled data selecting module selects one from among the sampled data such that a data sampled earlier is selected with decreasing engine speed (PBA) and with increasing engine load (PME).

It should be noted in the above that "at least" means that any other parameter(s) or value(s) may added or may instead be used.

It should also be noted in the above that, although the invention has been described taking a direct injection spark ignition engine as an example of the engine, the invention will also be applied to an ordinary engine which is injected fuel at a position before the intake valves, but is operable at the stoichiometric air/fuel ratio operation mode and the pre-mixture combustion operation mode.

It should further be noted that, although the invention has been described with reference to the engine whose throttle valve is driven by a stepper motor, the invention will also be applied to other type of the engine whose throttle value is driven by a similar actuator such as a torque motor and DC motor.

The entire disclosure of Japanese Patent Application No. 2000-216,013 filed on Jul. 17, 2000, including specification, claims, drawings and summary, is incorporated herein in reference in its entirety.

While the invention has thus been shown and described with reference to specific embodiments, it should be noted that the invention is in no way limited to the details of the described arrangements but changes and modifications may be made without departing from the scope of the appended claims.

What is claimed is:

1. A system for estimating an air/fuel ratio of each cylinder of an internal combustion engine having a plurality of cylinders which are connected to an exhaust system having an exhaust manifold, including:

an air/fuel ratio sensor installed at or downstream of a confluence point of the exhaust manifold and generating an output indicative of an air/fuel ratio exhausted from the cylinders;

air/fuel ratio sensor output sampling module which A/D converts the output of the air/fuel ratio sensor and stores successively as sampled data;

engine operating condition detecting module which detects operating conditions of the engine including at least an engine speed and an engine load;

sampled data selecting module which selects one from among the sampled data based on at least the engine speed and the engine load in the detected operating conditions of the engine, and estimates the air/fuel ratio of each cylinder from the selected sampled data based on a model describing a behavior of the exhaust manifold and designed based on assumption that the output of the air/fuel ratio sensor comprises a weight-average obtained by multiplying past firing histories of the cylinders by a weight coefficient and an observer for observing an internal state of the model, wherein the improvement comprises:

the system includes:

operation mode selecting module which selects an operation mode of the engine from at least a first operation mode in which a desired air/fuel ratio is set to be a stoichiometric air/fuel ratio, a second operation mode in which the desired air/fuel ratio is set to be an air/fuel ratio leaner than the stoichiometric air/fuel ratio and a third operation mode in which the desired air/fuel ratio is set to be an air/fuel ratio leaner than that of the second operation mode;

and the sampled data selecting module selects the one from among the sampled data based on at least the engine speed, the engine load and the selected operation mode, and estimates the air/fuel ratio of each cylinder from the selected sample, based on the model and the observer, for the selected operation mode of the engine.

2. A system according to claim 1, wherein the sample data selecting module selects the one from among the sampled data in accordance with mapped data retrievable by the engine speed, the engine load and the selected operation mode.

3. A system according to claim 2, wherein the sample data selecting module includes:

a plurality of mapped data prepared corresponding to the first to the third operation modes of the engine;

mapped data selecting module which selects one of the plurality of the mapped data in response to the selected operation mode; and mapped data retrieving module which retrieves the selected mapped data by the engine speed and the engine load to selects the one from among the sampled data;

and estimates the air/fuel ratio of each cylinder from the selected sample, based on the model and the observer, for the selected operation mode of the engine.

4. A system according to claim 2, wherein the sample data selecting module includes:

mapped data prepared to the first to the third operation modes of the engine;

mapped data retrieving module which retrieves the mapped data by the engine speed and the engine load to selects the one from among the sampled data; and model weight coefficient changing module which changes the weight coefficient of the model and a gain matrix of the observer in response to the selected operation mode;

and estimates the air/fuel ratio of each cylinder from the selected sample, based on the changed coefficient of the model and the changed gain matrix of the observer, for the selected operation mode of the engine.

5. A system according to claim 1, wherein the sampled data selecting module selects one from among the sampled data such that a data sampled later is selected as the operation mode changes from the first to the second, the second to the third.

6. A system according to claim 1, wherein the sampled data selecting module selects one from among the sampled data such that a data sampled earlier is selected with decreasing engine speed and with increasing engine load.

7. A system for estimating an air/fuel ratio of each cylinder of a direct injection spark ignition internal combustion engine having a plurality of cylinders which are connected to an exhaust system having an exhaust manifold, comprising:

an air/fuel ratio sensor installed at or downstream of a confluence point of the exhaust manifold and generating an output indicative of an air/fuel ratio exhausted from the cylinders;

air/fuel ratio sensor output sampling module which A/D converting the output of the air/fuel ratio sensor and stores successively as sampled data;

engine operating condition detecting module which detects operating conditions of the engine including at least an engine speed and an engine load;

operation mode selecting module which selects an operation mode of the engine from at least a first operation mode in which a desired air/fuel ratio is set to be a stoichiometric air/fuel ratio, a second operation mode in which the desired air/fuel ratio is set to be an air/fuel ratio leaner than the stoichiometric air/fuel ratio and a third operation mode in which the desired air/fuel ratio is set to be an air/fuel ratio leaner than that of the second operation mode;

sampled data selecting module which selects one from among the sampled data based on at least the engine speed and the engine load in the detected operating conditions of the engine and the selected operation mode, and cylinder air/fuel ratio estimating module which estimates the air/fuel ratio of each cylinder for the selected operation mode from the selected sampled data, based on a model describing a behavior of the exhaust manifold and designed based on assumption that the output of the air/fuel ratio sensor comprises a weight-average obtained by multiplying past firing histories of the cylinders by a weight coefficient and an observer for observing an internal state of the model.

8. A system according to claim 7, wherein the sample data selecting module selects the one from among the sampled data in accordance with mapped data retrievable by the engine speed, the engine load and the selected operation mode.

9. A system according to claim 8, wherein the sample data selecting module includes:

a plurality of mapped data prepared corresponding to the first to the third operation modes of the engine;

mapped data selecting module which selects one of the plurality of the mapped data in response to the selected operation mode; and mapped data retrieving module which retrieves the selected mapped data by the engine speed and the engine load to selects the one from among the sampled data.

10. A system according to claim 7, wherein the sampled data selecting module selects one from among the sampled data such that a data sampled later is selected as the operation mode changes from the first to the second, the second to the third.

11. A system according to claim 7, wherein the sampled data selecting module selects one from among the sampled data such that a data sampled earlier is selected with decreasing engine speed and with increasing engine load.

12. A system for estimating an air/fuel ratio of each cylinder of a direct injection spark ignition internal combustion engine having a plurality of cylinders which are connected to an exhaust system having an exhaust manifold, comprising:

an air/fuel ratio sensor installed at or downstream of a confluence point of the exhaust manifold and generating an output indicative of an air/fuel ratio exhausted from the cylinders;

air/fuel ratio sensor output sampling module which A/D converts the output of the air/fuel ratio sensor and stores successively as sampled data;

engine operating condition detecting module which detects operating conditions of the engine including at least an engine speed and an engine load;

operation mode selecting module which selects an operation mode of the engine from at least a first operation mode in which a desired air/fuel ratio is set to be a stoichiometric air/fuel ratio, a second operation mode in which the desired air/fuel ratio is set to be an air/fuel ratio leaner than the stoichiometric air/fuel ratio and a third operation mode in which the desired air/fuel ratio is set to be an air/fuel ratio leaner than that of the second operation mode;

sampled data selecting module which selects one from among the sampled data based on at least the engine speed and the engine load in the detected operating conditions of the engine, and cylinder air/fuel ratio estimating module which estimates the air/fuel ratio of each cylinder from the selected sampled data, based on a model describing a behavior of the exhaust manifold and designed based on assumption that the output of the air/fuel ratio sensor comprises a weight-average obtained by multiplying past firing histories of the cylinders by a weight coefficient and an observer for observing an internal state of the model;

wherein the cylinder estimating module includes:

model weight coefficient changing module which changes the weight coefficient of the model and a gain matrix of the observer in response to the selected operation mode;

and estimates the air/fuel ratio of each cylinder from the selected sample, based on the changed coefficient of the model and the changed gain matrix of the observer, for the selected operation mode of the engine.

13. A system according to claim 12, wherein the sampled data selecting module selects one from among the sampled data such that a data sampled later is selected as the operation mode changes from the first to the second, the second to the third.

14. A system according to claim 12, wherein the sampled data selecting module selects one from among the sampled data such that a data sampled earlier is selected with decreasing engine speed and with increasing engine load.

15. A method of estimating an air/fuel ratio of each cylinder of an internal combustion engine having a plurality of cylinders which are connected to an exhaust system having an exhaust manifold and an air/fuel ratio sensor installed at or downstream of a confluence point of the exhaust manifold and generating an output indicative of an air/fuel ratio exhausted from the cylinders, including the steps of:

(a) A/D converting the output of the air/fuel ratio sensor and storing successively as sampled data;

(b) detecting operating conditions of the engine including at least an engine speed and an engine load;

(c) selecting one from among the sampled data based on at least the engine speed and the engine load in the detected operating conditions of the engine, and for estimating the air/fuel ratio of each cylinder from the selected sampled data based on a model describing a behavior of the exhaust manifold and designed based on assumption that the output of the air/fuel ratio sensor comprises a weight-average obtained by multiplying past firing histories of the cylinders by a weight coefficient and an observer for observing an internal state of the model, wherein the improvement comprises:

the method includes the step of:

(d) selecting an operation mode of the engine from at least a first operation mode in which a desired air/fuel ratio is set to be a stoichiometric air/fuel ratio, a second operation mode in which the desired air/fuel ratio is set to be an air/fuel ratio leaner than the stoichiometric air/fuel ratio and a third operation mode in which the desired air/fuel ratio is set to be an air/fuel ratio leaner than that of the second operation mode;

and the step (c) selects the one from among the sampled data based on at least the engine speed, the engine load and the selected operation mode, and estimating the air/fuel ratio of each cylinder from the selected sample, based on the model and the observer, for the selected operation mode of the engine.

16. A method according to claim 15, wherein the step (c) selects the one from among the sampled data in accordance with mapped data retrievable by the engine speed, the engine load and the selected operation mode.

17. A method according to claim 16, wherein the step (c) includes the steps of:

(e) selecting one of a plurality of mapped data prepared corresponding to the first to the third operation modes of the engine, in response to the selected operation mode; and (f) retrieving the selected mapped data by the engine speed and the engine load to selects the one from among the sampled data;

and estimates the air/fuel ratio of each cylinder from the selected sample, based on the model and the observer, for the selected operation mode of the engine.

18. A method according to claim 16, wherein the step (c) includes:

(g) retrieving mapped data prepared to the first to the third operation modes of the engine by the engine speed and the engine load to selects the one from among the sampled data; and (h) changing the weight coefficient of the model and a gain matrix of the observer in response to the selected operation mode;

and estimates the air/fuel ratio of each cylinder from the selected sample, based on the changed coefficient of the model and the changed gain matrix of the observer, for the selected operation mode of the engine.

19. A method according to claim 15, wherein the step (c) selects one from among the sampled data such that a data sampled later is selected as the operation mode changes from the first to the second, the second to the third.

20. A method according to claim 15, wherein the step (c) selects one from among the sampled data such that a data sampled earlier is selected with decreasing engine speed and with increasing engine load.

21. A method of estimating an air/fuel ratio of each cylinder of a direct injection spark ignition internal combustion engine having a plurality of cylinders which are connected to an exhaust system having an exhaust manifold an air/fuel ratio sensor installed at or downstream of a confluence point of the exhaust manifold and generating an output indicative of an air/fuel ratio exhausted from the cylinders, comprising the steps of:

(a) A/D converting the output of the air/fuel ratio sensor and storing successively as sampled data;

(b) detecting operating conditions of the engine including at least an engine speed and an engine load;

(c) selecting an operation mode of the engine from at least a first operation mode in which a desired air/fuel ratio is set to be a stoichiometric air/fuel ratio, a second operation mode in which the desired air/fuel ratio is set to be an air/fuel ratio leaner than the stoichiometric air/fuel ratio and a third operation mode in which the desired air/fuel ratio is set to be an air/fuel ratio leaner than that of the second operation mode;

(d) selecting one from among the sampled data based on at least the engine speed and the engine load in the detected operating conditions of the engine and the selected operation mode, and (e) estimating the air/fuel ratio of each cylinder for the selected operation mode from the selected sampled data, based on a model describing a behavior of the exhaust manifold and designed based on assumption that the output of the air/fuel ratio sensor comprises a weight-average obtained by multiplying past firing histories of the cylinders by a weight coefficient and an observer for observing an internal state of the model.

22. A method according to claim 21, wherein the step (d) selects the one from among the sampled data in accordance with mapped data retrievable by the engine speed, the engine load and the selected operation mode.

23. A method according to claim 22, wherein the step (d) includes the steps of:

(f) selecting one of a plurality of mapped data prepared corresponding to the first to the third operation modes of the engine, in response to the selected operation mode; and (g) retrieving the selected mapped data by the engine speed and the engine load to selects the one from among the sampled data.

24. A method according to claim 21, wherein the step (d) selects one from among the sampled data such that a data sampled later is selected as the operation mode changes from the first to the second, the second to the third.

25. A method according to claim 21, wherein the step (d) selects one from among the sampled data such that a data sampled earlier is selected with decreasing engine speed and with increasing engine load.

26. A method of estimating an air/fuel ratio of each cylinder of a direct injection spark ignition internal combustion engine having a plurality of cylinders which are connected to an exhaust system having an exhaust manifold and an air/fuel ratio sensor installed at or downstream of a confluence point of the exhaust manifold and generating an output indicative of an air/fuel ratio exhausted from the cylinders, comprising the steps of;

(a) A/D converting the output of the air/fuel ratio sensor and storing successively as sampled data;

(b) detecting operating conditions of the engine including at least an engine speed and an engine load;

(c) selecting an operation mode of the engine from at least a first operation mode in which a desired air/fuel ratio is set to be a stoichiometric air/fuel ratio, a second operation mode in which the desired air/fuel ratio is set to be an air/fuel ratio leaner than the stoichiometric air/fuel ratio and a third operation mode in which the desired air/fuel ratio is set to be an air/fuel ratio leaner than that of the second operation mode;

(d) selecting one from among the sampled data based on at least the engine speed and the engine load in the detected operating conditions of the engine, and (e) estimating the air/fuel ratio of each cylinder from the selected sampled data, based on a model describing a behavior of the exhaust manifold and designed based on assumption that the output of the air/fuel ratio sensor comprises a weight-average obtained by multiplying past firing histories of the cylinders by a weight coefficient and an observer for observing an internal state of the model;

wherein the step (e) includes the step of:

(f) changing the weight coefficient of the model and a gain matrix of the observer in response to the selected operation mode;

and estimates the air/fuel ratio of each cylinder from the selected sample, based on the changed coefficient of the model and the changed gain matrix of the observer, for the selected operation mode of the engine.

27. A method according to claim 26, wherein the step (d) selects one from among the sampled data such that a data sampled later is selected as the operation mode changes from the first to the second, the second to the third.

28. A method according to claim 26, wherein the step (d) selects one from among the sampled data such that a data sampled earlier is selected with decreasing engine speed and with increasing engine load.

* * * * *